US007909196B2

(12) United States Patent
Turner et al.

(10) Patent No.: US 7,909,196 B2
(45) Date of Patent: Mar. 22, 2011

(54) CAN END WITH TAB FOR IMPROVED ACCESSIBILITY

(75) Inventors: Timothy Turner, Pecatonica, IL (US); Randall G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 874 days.

(21) Appl. No.: 10/846,416

(22) Filed: May 14, 2004

(65) Prior Publication Data

US 2005/0252917 A1 Nov. 17, 2005

(51) Int. Cl.
*B65D 17/34* (2006.01)

(52) U.S. Cl. ..... 220/269; 220/906; 413/14

(58) Field of Classification Search ..... 220/269, 220/906; 413/14
See application file for complete search history.

(56) References Cited

U.S. PATENT DOCUMENTS

| | | | | |
|---|---|---|---|---|
| 3,404,801 | A | | 10/1968 | Silver |
| 3,432,067 | A | | 3/1969 | Khoury |
| 3,591,038 | A | | 7/1971 | Mooring et al. |
| 3,604,589 | A | | 9/1971 | Fraze |
| 3,715,051 | A | | 2/1973 | Hanke |
| 3,780,902 | A | | 12/1973 | Hole |
| 3,795,341 | A | | 3/1974 | Ostrem |
| 3,863,801 | A | | 2/1975 | Pillnik |
| 3,941,276 | A | | 3/1976 | Patel |
| 3,967,754 | A | | 7/1976 | Ostrem |
| 3,984,025 | A | | 10/1976 | Khoury et al. |
| 4,130,219 | A | | 12/1978 | Mallorca et al. |
| 4,211,335 | A | * | 7/1980 | Langseder ..... 220/269 |
| 4,266,688 | A | * | 5/1981 | Reid ..... 220/273 |
| 4,276,993 | A | | 7/1981 | Hasegawa |
| 4,363,419 | A | | 12/1982 | Walz, Sr. |
| 4,372,462 | A | | 2/1983 | Dassler et al. |
| 4,416,389 | A | | 11/1983 | Wilkinson et al. |
| 4,576,304 | A | | 3/1986 | Henning |
| D289,017 | S | | 3/1987 | Spangler et al. |

(Continued)

FOREIGN PATENT DOCUMENTS

CN 1035088 A 8/1989

(Continued)

OTHER PUBLICATIONS

"Math2.org Math Tables: Trigonometric Tables." http://math2.org/math/trig/tables.htm. Jun. 2010.*

*Primary Examiner* — Anthony Stashick
*Assistant Examiner* — James N Smalley
(74) *Attorney, Agent, or Firm* — Ungaretti & Harris LLP

(57) ABSTRACT

A can end for a container has a curl defining an outer perimeter of the can end. A chuckwall extends downwardly from the curl. A means for increasing the strength of the can end is integral with the chuckwall, and a center panel is integral with the means for increasing the strength of the can end. The center panel has a product side, a public side, a rivet, and a displaceable tear panel. A non-detachable tab is staked to the central panel wall by the rivet. First and second void regions of the tab are separated by a narrow strip of the central webbing. A portion of the narrow strip extends downwardly and approaches the public side of the central panel wherein a height of the lift end of the tab above the public side of the central panel is maintained at a predetermined height.

21 Claims, 7 Drawing Sheets

U.S. PATENT DOCUMENTS

| | | | | | |
|---|---|---|---|---|---|
| 4,733,793 | A | | 3/1988 | Moen | |
| 4,804,104 | A | | 2/1989 | Moen | |
| 4,877,129 | A | * | 10/1989 | Wells | 220/269 |
| 4,930,658 | A | | 6/1990 | McEldowney | |
| 5,129,541 | A | | 7/1992 | Voigt et al. | |
| 5,131,555 | A | * | 7/1992 | DeMars et al. | 220/269 |
| 5,456,378 | A | * | 10/1995 | DeMars | 220/269 |
| 5,494,184 | A | | 2/1996 | Noguchi et al. | |
| 5,655,678 | A | * | 8/1997 | Kobayashi | 220/269 |
| 5,711,448 | A | * | 1/1998 | Clarke, III | 220/269 |
| 5,715,964 | A | * | 2/1998 | Turner et al. | 220/269 |
| 5,741,105 | A | | 4/1998 | Schubert et al. | |
| 5,749,488 | A | * | 5/1998 | Bagwell et al. | 220/269 |
| 5,799,816 | A | | 9/1998 | Schubert | |
| 5,964,366 | A | * | 10/1999 | Hurst et al. | 220/269 |
| 6,024,239 | A | * | 2/2000 | Turner et al. | 220/269 |
| 6,053,349 | A | | 4/2000 | Griggs, Jr. et al. | |
| 6,161,717 | A | * | 12/2000 | Forrest et al. | 220/269 |
| 6,460,723 | B2 | * | 10/2002 | Nguyen et al. | 220/619 |
| 6,951,293 | B2 | | 10/2005 | Thibaut | |

FOREIGN PATENT DOCUMENTS

| | | | | |
|---|---|---|---|---|
| EP | 542 517 | A | | 5/1993 |
| JP | 57-196640 | | | 12/1982 |
| JP | 01182247 | A | * | 7/1989 |
| JP | 08053131 | | | 2/1996 |
| JP | 2002-21156 | A | | 7/2002 |
| WO | WO 9413544 | A1 | * | 6/1994 |
| WO | WO 0071430 | | | 11/2000 |

* cited by examiner

CAN END WITH TAB FOR IMPROVED ACCESSIBILITY

TECHNICAL FIELD OF THE INVENTION

The present invention relates to the manufacture of an opening tab for container ends; specifically opening tabs for retained-tab beer and beverage container ends.

BACKGROUND OF THE INVENTION

Pull tabs for container ends are used on various types of containers, including beer and beverage containers, food containers, and many other types of containers for household or industrial use. The most prevalent type of pull-tab container ends is the retained-tab end, which have a tab designed to remain on the container end after the container is opened, such as with beer and beverage metal containers. The typical beverage cans used today have a non-detachable tab, called the "ecology tab" because of the fact that the predecessor types of tabs were removed when the container was opened and were causing pollution concerns.

The typical non-detachable tabs used in the beverage container industry are of generally the same design. These tabs have a nose portion, a lift end portion, separated by a central body portion that has an aperture provided for securing the tab to the end by a rivet. The tab is manufactured separately from the end, and is secured to the end such that the nose is positioned over the scoreline of the end. When the tab is lifted at the lift end by the user, the nose of the tab is pushed down on the end panel to fracture the score and open the container. The rivet, therefore, acts as a fulcrum for the rotation of the tab, and a central hinge area of the tab bends adjacent the rivet across a hinge line of the tab.

A problem with the non-detachable tabs is the inability for the user to access the lift end due to the limited distance between the lift end and the central panel of the can end. This inaccessibility is compounded by the reduction of the area of the central panel as the can end diameter is reduced to lower metal cost. The spacing between the lift end and the central panel must be sufficient to allow the user to frictionally engage the tab while providing an upward force to initiate movement of the tab nose downward to fracture the score and open the container.

SUMMARY OF THE INVENTION

It is an object of the present invention to provide a can end for a container. The can end has a curl defining an outer perimeter of the can end. A chuckwall extends downwardly from the curl. The chuckwall is joined to a center panel. The center panel is centered about a longitudinal axis, and has a product side, a public side, a rivet, and a displaceable tear panel at least substantially defined by a frangible score and a non-frangible hinge segment. A non-detachable tab is staked to the center panel by the rivet. The non-detachable tab has a nose end extending over a portion of the tear panel, a lift end opposite the nose end, and a central webbing between the nose end and the lift end. The central webbing has a hinge region and a rivet island surrounding the rivet. The rivet island is at least partially surrounded by a first void region to provide a first exposed area of the center panel. The central webbing also has a second void region between the lift end and the first void region to provide a second exposed area of the center panel. The first and second void regions are separated by a narrow strip of the central webbing. A portion of the narrow strip extends downwardly and approaches the public side of the center panel wherein a height of the lift end of the tab above the public side of the center panel is maintained at a predetermined height.

It is also an object of the present invention to provide a non-detachable tab having a nose end extending over a portion of the tear panel, a lift end opposite the nose end, and a central webbing between the nose and lift end. The webbing has a hinge region and a rivet island surrounding the rivet. The rivet island is at least partially surrounded by a first void region to provide a first exposed area of the center panel. The central webbing also has a second void region between the lift end and the first void region to provide a second exposed area of the center panel. The second void region has a perimeter defined by a curl of the central webbing. A portion of the curl extends downwardly and approaches the public side of the center panel wherein a height of the lift end of the tab above the public side of the center panel is maintained at a predetermined height.

Other advantages and aspects of the invention will become apparent upon making reference to the specification, claims, and drawings to follow.

DETAILED DESCRIPTION OF THE INVENTION

Figure 1:
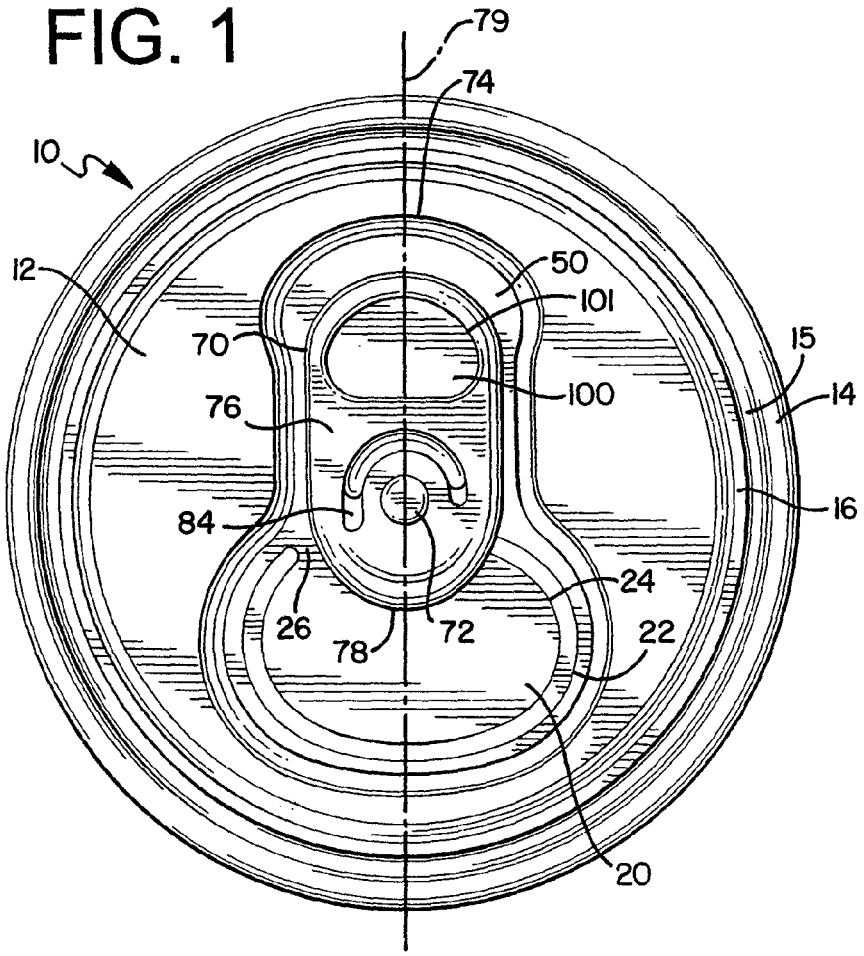
FIG. 1 is a top view of the public side of the can end of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The present invention relates to a retained-tab can end for a container having improved accessibility and thus improved ease of openability. The retained-tab can end according to the present invention is typically a beer and beverage container end, having a retained tab and, therefore, being identified as "ecology" or "easy-stay" container ends. However, it is contemplated that the present invention may be use with other types of container ends, such as food and other containers in which a lift-tab is useful to open the container.

The Can End

Figure 2:
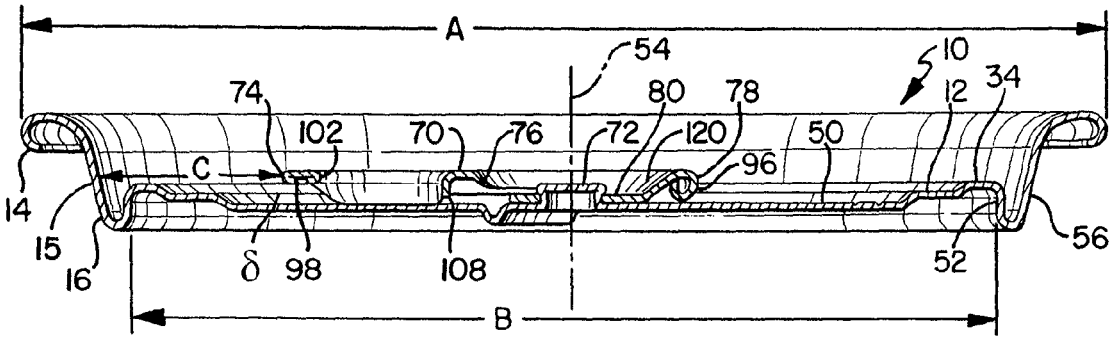
FIG. 2 is a cross-sectional view of the can end of FIG. 1.

Referring to FIGS. 1 and 2, the can end, or end closure, or end member, 10 for a container (not shown) has a central or center panel wall 12 having a seaming curl 14 for joining the wall to the container. The container is typically a drawn and ironed metal can, usually constructed from a thin plate of aluminum or steel, such as the common beer and beverage containers. End closures for such containers are also typically constructed from a cut edge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is interconnected to the central panel 12 by a chuckwall 15 and a countersink area 16 which is joined to the central panel 12 outer peripheral edge of the central panel 12. This type of means for joining the central panel 12 to a container is presently the typical means for joining used in the industry, and the structure described above is formed in the process of forming the blank end from a cut edge of metal plate, prior to the end conversion process. However, other means for joining the central panel 12 to a container may be employed with the present invention.

The outer peripheral edge of the central panel 12 may be coined to add strength to can end 10. Coining is the work hardening of metal between tools. The metal is typically compressed between a pair of tools, generally an upper and lower tool.

The central panel wall 12 has a displaceable tear panel 20 defined by a curvilinear frangible score 22 with an adjacent anti-fracture score 24 on the tear panel 20, and a non-frangible hinge segment 26. The hinge segment 26 is defined by a generally straight line between a first end and a second end of the frangible score 22. The tear panel 20 of the central panel 12 may be opened, that is the frangible score 22 may be severed and the tear panel 20 displaced at an angular orientation relative to the remaining portion of the central panel 12, while the tear panel 20 remains hingedly connected to the central panel 12 through the hinge segment 26. In this opening operation, the tear panel 20 is displaced at an angular deflection, as it is opened by being displaced away from the plane of the panel 12.

The frangible score 22 and the second groove or anti-fracture score 24 are formed using conventional-type of scoring operation during the can end forming process, using tools including an upper (public side) die with a score knife and a lower (product side) die with an anvil surface.

The frangible score 22 includes a length defined by a thickened portion of the residual. This length is often referred to as a check slot region. The check slot causes the propagation of the fracture of the frangible score 22 to slow naturally as the fracture reaches the check slot region. This allows the container to vent safely before the fracture of the frangible score 22 continues.

A deboss panel 50 is formed in the public side 34 of the central panel 12. The deboss panel 50 is formed in the central panel 12 using conventional die-forming techniques.

The end member 10 described herein is used to produce a lightweight closure, for example from an 0.0084 inch thick aluminum stock for attachment to a container necked to a 202 (2.125 inches) or smaller open end. Accordingly, a diameter A of the can end 10 is typically about 2.340 inches, and diameter B of the center panel 12 is typically less than 2.340 inches. Preferably, the diameter B of the center panel 12 is less 1.500 to 2.340 inches; more preferably, the diameter B is the less than 1.90 inches; and most preferably the diameter B is about 1.880 inches, or any range or combination of ranges therein. It should be understood that these values are merely examples. The invention disclosed herein could be applied to any can end size, including but not limited to 200, 206, and 209 end members. End members 10 of the present invention are generally manufactured using a multi-stage reforming method.

Referring still to FIGS. 1 and 2, an end member 10 of the present invention includes a means for joining the chuckwall 15 to the center panel 12 as a countersink 16, also called an annular reinforcing or anti-peaking bead. The countersink 16 has an inner wall 52 integrally connected to the peripheral edge of the center panel 12 through an annular arcuate segment. Accordingly, the inner wall extends downwardly from the center panel 12, generally at a very small angle from a vertical axis substantially perpendicular to the center panel 12 or parallel to a longitudinal axis 54. This angle is generally between ±5 to 10 degrees, or any range or combination of ranges therein.

The inner wall 52 is joined to an outer wall 56 through an annular arcuate portion, the lower extent of which defines a baseline. The outer wall is angled outwardly relative to the vertical axis. The angle is generally on the order of 0 to 30 degrees, more preferably 15 to 30 degrees, and most preferably 20 to 30 degrees, or any range or combination of ranges therein. The outer wall 56 is integral with the chuckwall 15.

Figure 3:
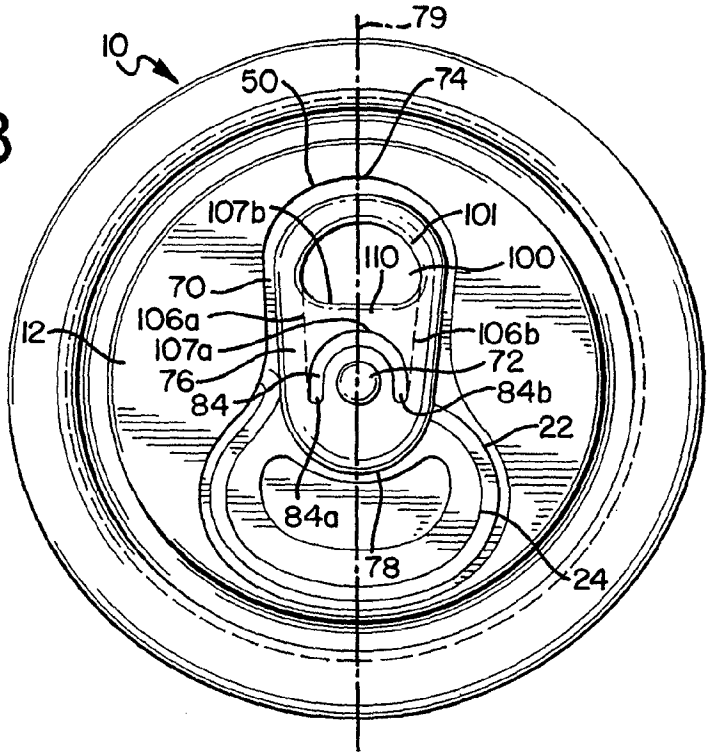
FIG. 3 is a top view of the public side of the can end of the present invention.
Figure 4:
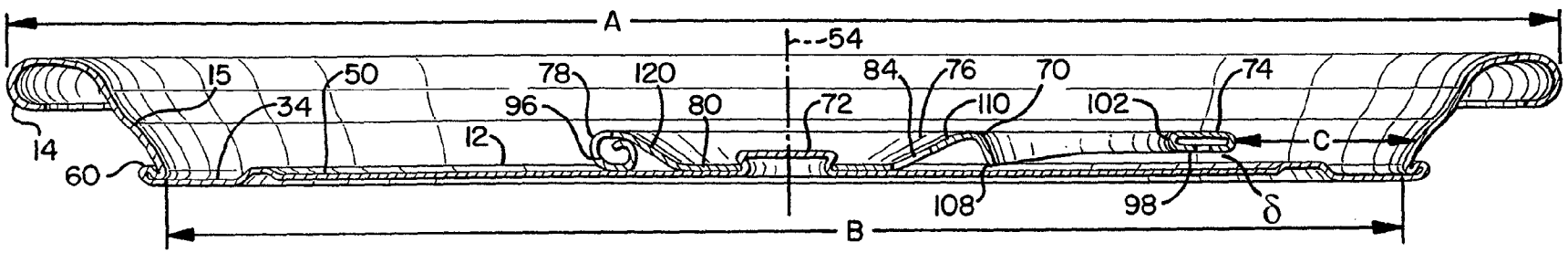
FIG. 4 is a cross-sectional view of the can end of FIG. 3.
Figure 5:
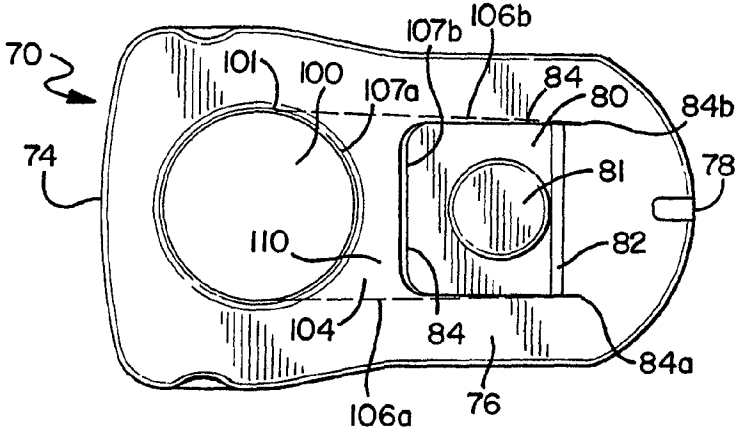
FIG. 5 is a top view of a non-detachable tab.
Figure 6:
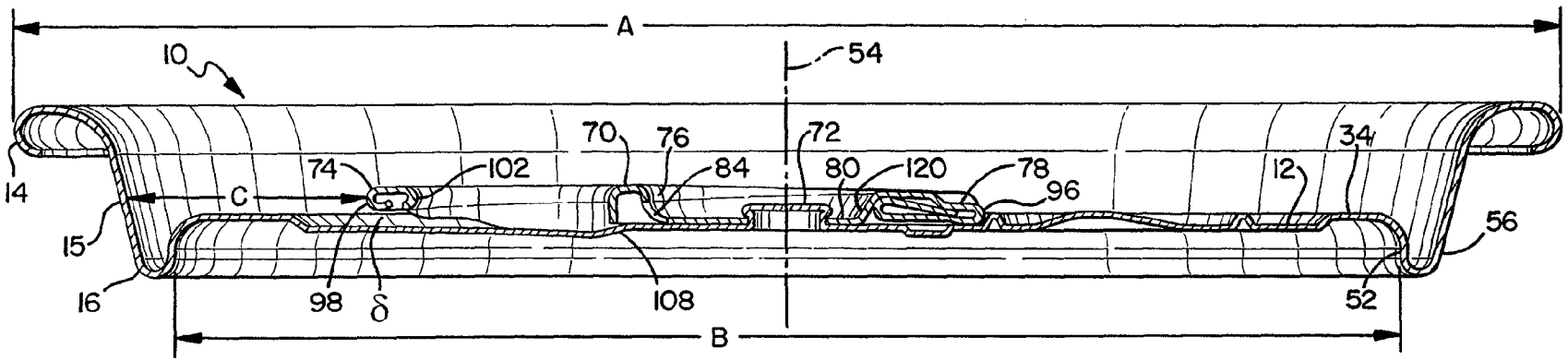
FIG. 6 is a cross-sectional view of a can end of the present invention having the tab of FIG. 5.

In FIGS. 3 and 4, the can end 10 is shown with a fold 60 joining the chuckwall 15 to the center panel 12 rather than a countersink.

The Tab

Referring to FIGS. 1 and 3, the end member 10 also has a non-detachable tab 70 secured or staked to the center panel 12 by a rivet 72. The tab 10 is constructed of a rigid material, typically aluminum alloy metal, and is substantially flat, generally disposed along a common plane. The tab 70 has a lift end 74, a central webbing 76, and a nose portion 78. The lift end 74 and the nose portion 78 are generally aligned along a central axis 79 passing through the rivet 72. The rivet 72 is formed in the typical manner.

The user initiates opening of the end member 10 by lifting the lift end 74 of the tab 70. This lifts the rivet 72 which causes the score groove 22 to fracture in a vent region which is located at least partially within the bounds of a coined region surrounding the rivet 72. As the nose portion 78 presses against the tear panel 20, the fracture of the score 22 propagates around the tear panel 20, preferably in progression from the first end of the score 22 toward the second end of the score 22.

Figure 7:
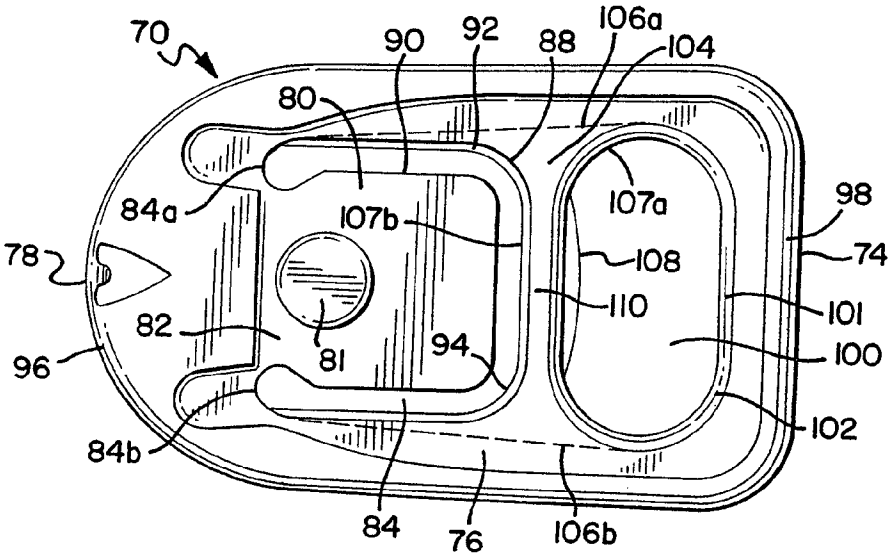
FIG. 7 is a top view of a non-detachable tab.
Figure 8:
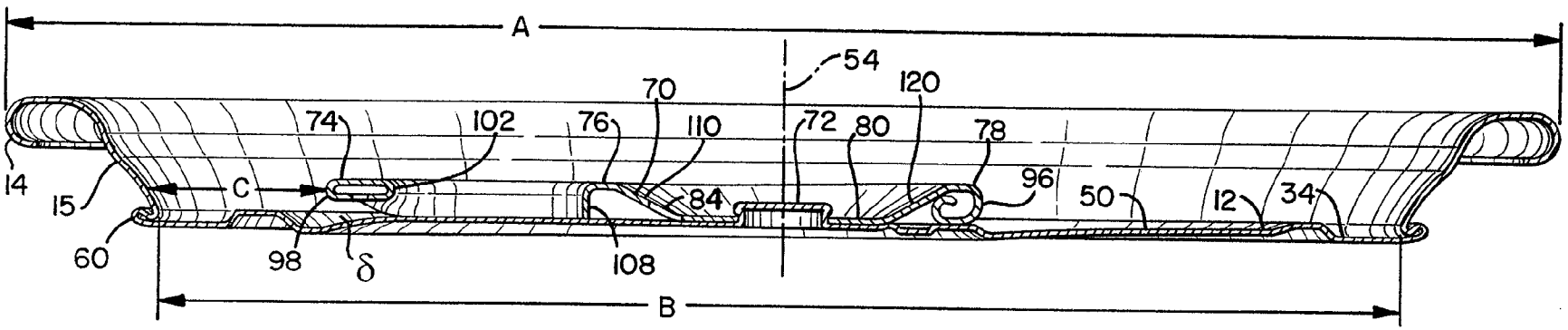
FIG. 8 is a cross-sectional view of a can end of the present invention.

Referring to FIG. 7, the central webbing 76 of the tab 70 has a rivet island 80 with an aperture 81 adapted for receiving the rivet 72 to secure the tab 70 to the center panel wall 12 of the can end 10. The rivet island 80 is generally defined by hinge region 82 and a rivet island window 84 exposing a first exposed area of the center panel. The window 84 is preferably a curvilinear shaped opening or void region having a first end **84*a* and a second end 84*b*. The hinge region 82 preferably appears as a tongue of the tab webbing 76 which joins the rivet island 80 to the remaining webbing 76. The hinge region 82 has a hinge line between the first and second ends 84*a*, 84*b* of the window 84**, preferably defined as a straight line therebetween.

The window 84 has a first edge 88 defining the outer side of the curvilinear opening and a second edge 90 defining the inner side of the curvilinear opening. The window 84 is preferably formed by lancing the metal and subsequently bending back the metal on either or both sides of the lance to form a widened opening. The expansion of the lance by bending metal back, an operation called "wipe down," causes a bend 94 of the metal along the edge of the window 84, appearing as a fold or curl. Another practiced method of forming the window 84, although likely to result in lesser rigidity and stress resistance, is to merely stamp out a blank of metal in the shape of the window 84, without any bending of the edges of the window 84.

The bend of metal in the ends of the window 84, referred to henceforth as the curl 94 in the edges of the ends 84*a*, 84*b* of the window 84, provides a collar in the edges, as a structural component to increase the strength of the metal in the ends 84*a*, 84*b* and to resist stresses and prevent tearing during use of the tab 70. This added strength is primarily provided by the curl 94 providing an alteration in the direction of the metal, by bending the metal to a direction outside the planar path of the webbing region. With such alteration in the directional orientation of the metal in the ends 84*a*, 84*b*, the metal in the region of the curl 94 has an increased resistance to the sheer forces on the metal when the tab 70 is used for opening the container end. It is also believed that added strength in the ends 84*a*, 84*b*, is provided by the residual stress state of the metal in and around the curl 94.

The nose 78 is preferably integral with a folded edge (curl) 96 of the outer periphery of the tab 70. The lift end 74 of the tab 70 also has a folded edge (curl) 98. The folded edge 96 of the nose 78 and the similar folded edge of the outer periphery of the lift end 74 have a bend of the metal and are adapted to provide strength of the tab 70 to resist stress from outside the plane. The tab 70 also has another void region or window, i.e. a finger hole 100, having a perimeter 101 preferably being defined by a downwardly projecting inner folded, or curled, edge 102 of the central webbing 76 which provides a smooth inner edge of the finger hole 100 and strengthens the metal of the outer periphery of the finger hole 100. The finger hole 100 is located between the lift end 74 and the window 84 to provide a second exposed area of the center panel 12.

The window 84 and the finger hole 100 are separated by a narrow strip 104 of the central webbing 76. Opposing longitudinal sides 106*a*, 106*b* of the narrow strip 104 extend from the widest segment of the finger hole 100 in a straight line to the widest segment of the window 84. The opposing sides (dashed lines 106*a*, 106*b*) slightly converge from wider finger hole 100 inwardly to the window 84. Opposing curvilinear transverse sides 107*a*, 107*b* of the narrow strip 104 comprise portions of the window 84 curl 94 and the finger hole 100 curled edge 102, respectively. A portion 108 of the narrow strip 104 extends downwardly and approaches the public side 34 of the center panel 12. This ensures that a height δ of the lift end 74 of the tab 70 above the public side 34 of the center panel 12 is maintained at a predetermined height. This portion of the narrow strip 104 is particularly advantageous to improve the accessibility of the lift end 74 if the tab 70. Due to the relatively small area of the can end 10 and the center panel 12, it is difficult for a user to access the lift end 74 with his or her finger. A can end 10 of the present invention typically has a small distance C between the lift end 74 of the tab 70 and the chuckwall 15. (See FIGS. 2 and 4). The magnitude of this distance C can be less than the magnitude of the height δ of the lift end 74 of the tab 70 above the public side 34 of the center panel 12. The distance C is preferably less than 0.050 inches; more preferably, the distance C is less than 0.040 inches; and most preferably, the distance C is between 0.030 and 0.040 inches, or any range or combination of ranges therein.

The portion of the narrow strip 104 ensuring the height δ of the lift end 74 above the public side of the central panel 12 is preferably a portion of the window 84 curl 94 or the finger hole 100 curled edge 102; more preferably, the portion of the narrow strip 104 ensuring the height δ of the lift end 74 above the public side 34 of the central panel 12 is a portion of the window 84 curl 94 or the finger hole 100 curled edge 102 having a greater radius of curvature than remaining portions of the curls 94, 102; still more preferably, the portion of the narrow strip 104 ensuring the height δ of the lift end 74 above the public side 34 of the central panel 12 is a portion of the window 84 curl 94 or the finger hole 100 curled edge 102 located along the narrowest extent 110 of the narrow portion 104 where the spacing between the window 84 and the finger hole 100 is shortest; still more preferably, the portion of the narrow strip 104 ensuring the height δ of the lift end 74 above the public side 34 of the central panel 12 is a portion of the window 84 curl 94 or the finger hole 100 curled edge 102 located along the narrowest extent 110 and is adapted to engage the public side 34 of the center panel 12; and most preferably, the portion of the narrow strip 104 ensuring the height δ of the lift end 74 above the public side 34 of the central panel 12 is a portion of the finger hole 100 curled edge 102 located along the narrowest extent 110 and engages the public side 34 of the center panel 12. Alternatively, any portion of the finger hole 100 curled edge 102 may be adapted to maintain the height δ. Furthermore, one of ordinary skill on the art would appreciate that any of the combinations could be combined without departing from the spirit of the invention.

Figure 9:
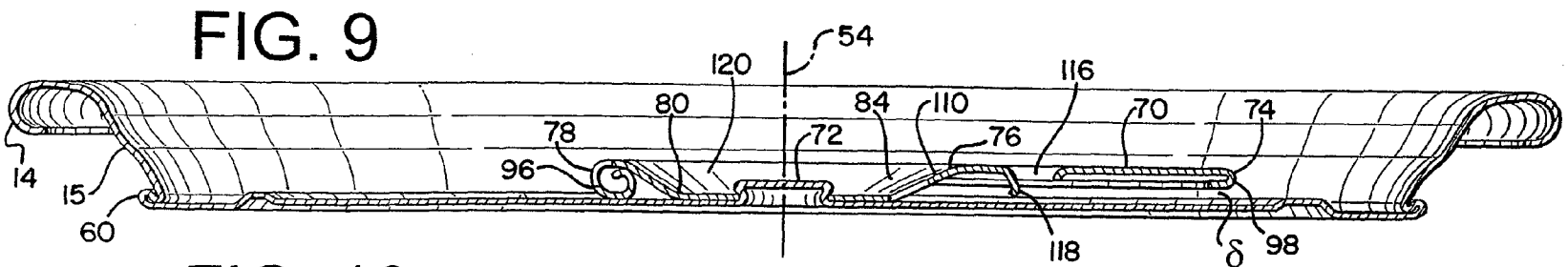
FIG. 9 is a cross-sectional view of a can end of the present invention.
Figure 10:
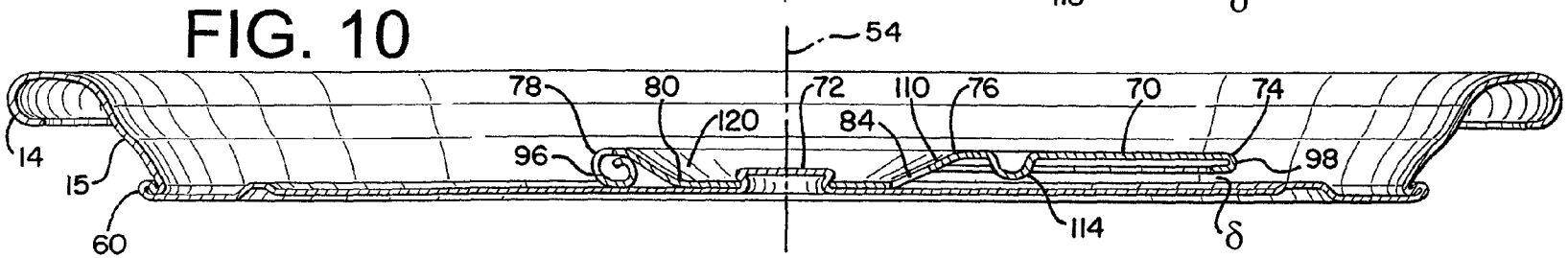
FIG. 10 is a cross-sectional view of a can end of the present invention.
Figure 12:
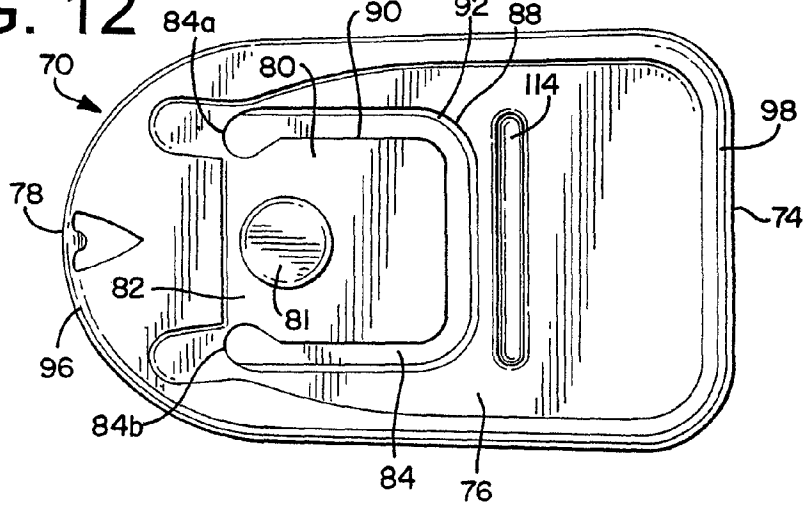
FIG. 12 is a top view of a tab of FIG. 10.
Figure 11:
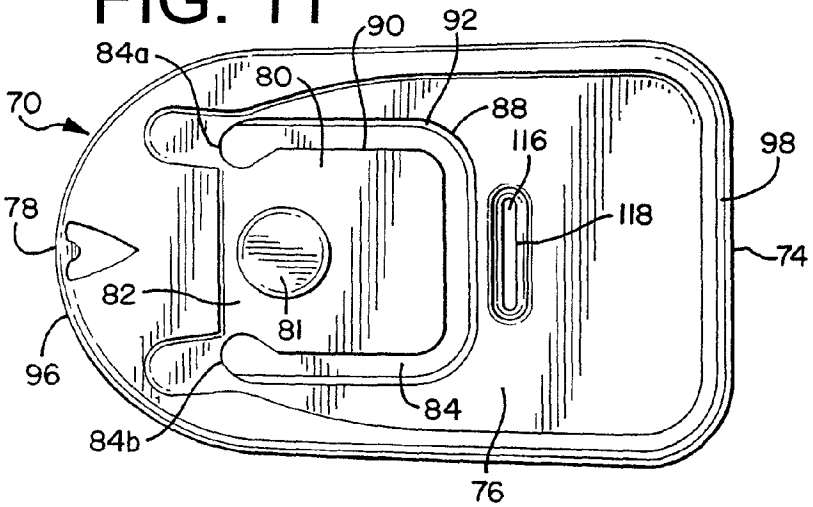
FIG. 11 is a top view of a tab of FIG. 9.
Figure 13:
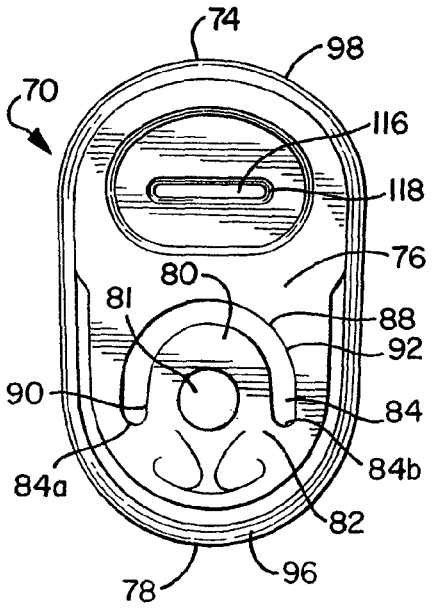
FIG. 13 is a top view of a non-detachable tab.
Figure 14:
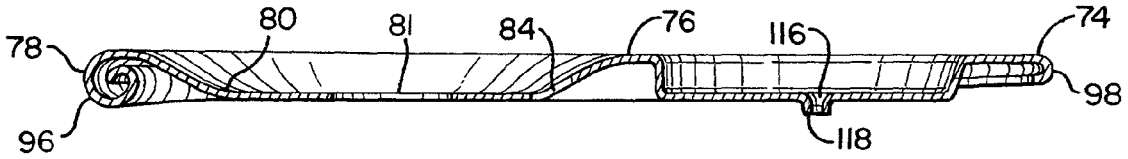
FIG. 14 is a cross-sectional view of the tab of FIG. 13.
Figure 15:
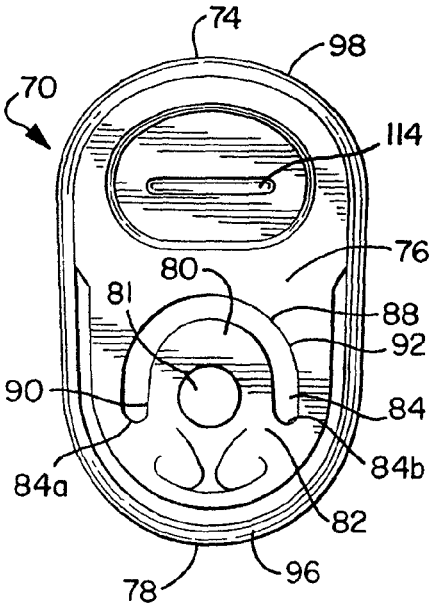
FIG. 15 is a top view of a non-detachable tab.
Figure 16:
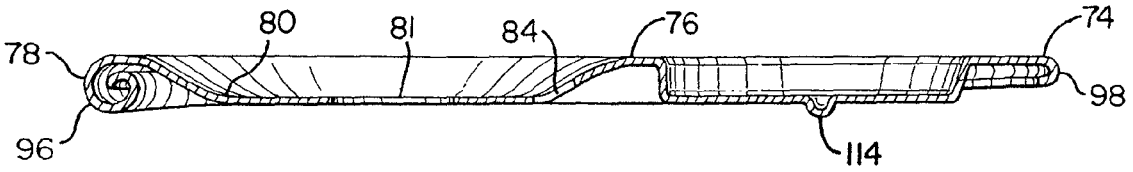
FIG. 16 is a cross-sectional view of the tab of FIG. 15.

As illustrated in FIGS. 9-16, the tab 70 is sometimes manufactured without a finger hole. In this case, print, such as promotional information, is provided in the area of the central webbing 76 where the finger hole is typically located. In these embodiments, a down bead or detent 114, as it would appear in cross-section, may be provided to maintain the height δ at a predetermined level as shown in FIGS. 10 and 16. Alternatively, as shown in FIGS. 9 and 14, a second void region or window 116 can be formed in the webbing 76 between the first window 84 and the lift end 74. The second window 116 is preferably formed in the same manner that the first window 84 is formed, i.e. by lancing the metal and a subsequent wipe down process of the metal on either or both sides of the lance to form a widened opening. The wipe down causes a bend 118 of the metal along the edge of the second window 116, appearing as a fold or curl. A portion of the bend 118 provided for maintaining the height δ at a predetermined level as shown on FIGS. 9 and 14.

Figure 17:
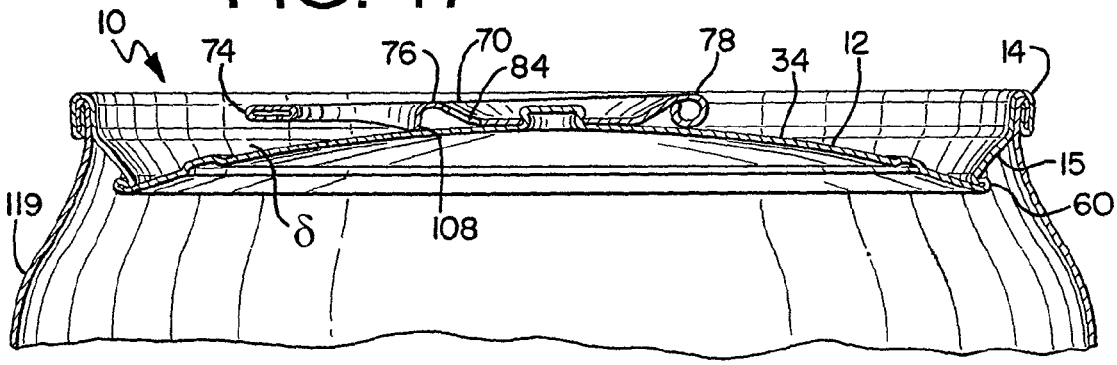
FIG. 17 is a cross-sectional view of a pressurized container including an end member with a non-detachable tab.
Figure 18:
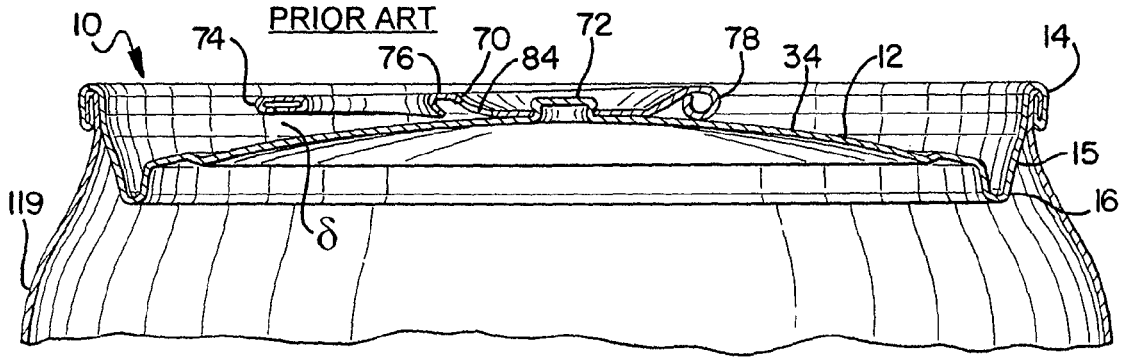
FIG. 18 PRIOR ART
FIG. 18 is a cross-sectional view of a prior art pressurized container including an end member with a non-detachable tab.

It should be understood that the portion of the tab 70 provided for maintaining the height δ at a predetermined level above the center panel 12 may not engage the center panel 12 until the container is pressurized, i.e. filled with a beverage to form a pressurized beverage containing vessel. As shown in FIG. 17, a container body 119 filled with a beverage is closed by an end member 10, sealing a beverage within the vessel. At which point, an internal pressure causes an outwardly directed force on the center panel 12 to cause the center panel 12 to dome outwardly. As the center panel 12 becomes dome-shaped, the portion of the tab 70 provided for maintaining the height δ engages the center panel 12. As the center panel 12 becomes larger, the doming is increased. Thus, a 209 end will undergo much more doming than a 200 end, and as the doming is increased, the length of the portion of the tab 70 provided for maintaining the height δ can be decreased. A prior art container is shown in FIG. 18. The height δ exhibited by the prior art end member is uncontrolled. Therefore, the height δ can vary greatly depending on the amount of doming, the size of the end member, etc.

It is desired to maintain the height δ at a predetermined level above the center panel 12, typically greater than 0.050 inches. However, the height δ is preferably 0.050 to 0.100 inches; more preferably, the height δ is greater than 0.060 and/or less than or equal to 0.090 inches; and most preferably, the height δ is greater than 0.070 and/or less than or equal to 0.080 inches. The height δ may also be any range or combination of ranges set forth herein. It should be understood that depending on the length of the tab 70 and the size of the end 10, e.g. 200, 202, 206, 209, etc. ends, the height δ can vary greatly, as can the distance C between the lift end 74 and the chuckwall 15. It should also be understood that an objective of the present invention is to maintain the height δ at any desired predetermined level. Another objective is to maximize the height δ without having the tab 70 rise above the double seam when the container is pressurized to around 60 PSI.

As best illustrated in FIG. 1, the central webbing 76 preferably has a deboss bend 120, a sloped region of the metal which results in a central deboss region of the central webbing 76 inward of the deboss bend 120. This deboss region provides a lowered plane of the metal in the central webbing 76. This structure of the tab central webbing 76 is adapted to lower the rivet island 80, such that the lower surface of the rivet island 80 is positioned directly against the central panel 12 of the can end 10, secured to the center panel 12 by the rivet 72 passing through the rivet island opening 81, and staked thereto by stamping the top of the rivet 72. The tab 70 is secured in this manner in a position whereby the nose 78 extends partially over the tear panel 20 of the center panel 20 and the hinge line of the tab 70 is generally aligned with the proximal edge of the tear panel 20.

In operation, the tab 70 is lifted at the lift end 74, operable by the user's finger applying a lifting force at the lift end 74. Lifting the lift end 74 forces the nose 78 of the tab 70 downward, to force the nose 78 against the tear panel 20 of the end 10. Because the rivet 72 maintains the rivet island 80 against the center panel 12, the tab 70 remains attached to the end 10 and bends across the hinge line 86 of the tongue of the central webbing region 76. The collar of each terminal end 84*a*, 84*b* of the window provides resistance to tearing of the metal across the hinge line 86 during use of the tab 70.

Several alternative embodiments have been described and illustrated. A person ordinary skilled in the art would appreciate that the features of the individual embodiments, for example, variations of the countersink and folded portions, can be applied in combination with any of the tab variations to arrive at a suitable can end member. A person ordinary skilled in the art would further appreciate that any of the embodiments of the tab could be provided in any combination with the folded transition wall and/or the chuckwall variations disclosed herein. Further, the terms "first," "second," "upper," "lower," etc. are used for illustrative purposes only and are not intended to limit the embodiments in any way, and the term "plurality" if used herein is intended to indicate any number greater than one, either disjunctively or conjunctively as necessary, up to an infinite number. As used herein, the word "maintain" is defined as controlling or keeping in an existing or desired state, such as keeping the height δ greater than 0.050. As used herein, the word "predetermined" means to determine beforehand.

While specific embodiments have been illustrated and described, numerous modifications come to mind without significantly departing from the spirit of the invention and the scope of protection is only limited by the scope of the accompanying claims.

We claim:

1. A non-detachable tab for a can end including a center panel having a product side, a public side, a rivet, and a displaceable tear panel in the center panel at least substantially defined by a frangible score and a non frangible hinge segment, a central axis extending through the rivet and substantially bisecting the displaceable tear panel, and a curl defining the outer perimeter of the can end, the non-detachable tab staked to the center panel by the rivet, the non-detachable tab comprising:

a nose end extending over a portion of the tear panel and aligned with the central axis in a position to begin a can end opening sequence;

a lift end opposite the nose end and aligned with the central axis in the position to begin the can end opening sequence; and a central webbing between the nose and lift end, the webbing having a hinge region and a rivet island surrounding the rivet, the rivet island being at least partially surrounded by a first void region to provide a first exposed area of the center panel, a second void region to provide a second exposed area of the center panel is separated from the first void region by a narrow strip of the central webbing, the narrow strip defined by a region between a widest segment of the second void region and a widest segment of the first void region, the second void region defined by a curled edge of the narrow strip, a portion of the curled edge of the narrow strip having a greater radius of curvature than remaining portions of the curled edge in the narrow strip and extending downwardly below the rivet island and approaching the public side of the center wherein a height of the lift end of the tab above the public side of the center panel is maintained at a predetermined level above the center panel and below the curl defining the outer perimeter of the can end.

2. The non-detachable tab of claim 1 wherein a height of the lift end of the tab above the public side of the center panel is maintained at greater than 0.050 inches.

3. The non-detachable tab of claim 1 wherein the portion of the curled edge is adapted to engage the public side of the center panel.

4. The non-detachable tab of claim 1 wherein the portion of the curled edge engages the public side of the center panel.

5. The non-detachable tab of claim 1 wherein the height of the lift end is between 0.050 inches and 0.080 inches.

6. The non-detachable tab of claim 1 wherein the height of the lift end is greater than 0.060 inches.

7. The non-detachable tab of claim 1 wherein the height of the lift end is greater than 0.070 inches.

8. The non-detachable tab of claim 1 wherein the center panel has a diameter less than 1.90 inches.

9. A can end for a container, the can end comprising:

a curl defining an outer perimeter of the can end;

a chuckwall extending downwardly from the curl;

a dome-shaped center panel centered about a longitudinal axis, and having a product side, a public side, a rivet, and a displaceable tear panel in the dome-shaped center panel at least substantially defined by a frangible score and a non frangible hinge segment recessed within a deboss panel;

a means for joining the chuckwall to the dome-shaped center panel;

a central axis extending through the rivet and substantially bisecting the displaceable tear panel; and a non-detachable tab recessed within the deboss panel and staked to the dome-shaped center panel by the rivet, the non-detachable tab having a nose end extending over a portion of the tear panel and aligned with the central axis in a position to begin a can end opening sequence, a lift end opposite the nose end panel and aligned with the central axis in a position to begin a can end opening sequence, and a central webbing between the nose and lift end, the webbing having a hinge region and a rivet island surrounding the rivet, the rivet island being at least partially surrounded by a first void region to provide a first exposed area of the dome-shaped center panel, a portion of the tab located between the first void region and the lift end extending downwardly below the rivet island and approaching the public side of the dome-shaped center panel and ensuring that a height of the lift end of the tab above the public side of the dome-shaped center panel is maintained at a predetermined level greater than 0.050 inches and below the curl defining the outer perimeter of the can end.

10. The can end of claim 9 wherein the central webbing further comprises a second void region between the lift end and the first void region to provide a second exposed area of the dome-shaped center panel, a narrow strip of the central webbing separating the first and second void, a portion of the narrow strip extending downwardly and approaching the public side of the dome-shaped center panel and ensuring that a height of the lift end of the tab above the public side of the dome-shaped center panel is maintained at greater than 0.050 inches.

11. The can end of claim 10 wherein the second void region has a perimeter defined by a downwardly projecting curl of the central webbing, a portion of the curl along the narrow strip of the central webbing separating the first void region from the second void region approaching the public side of the dome-shaped center panel to ensure the height of the lift end above the public side of the dome-shaped center panel is greater than 0.050 inches.

12. The can end of claim 11 wherein the portion of the curl has a radius of curvature greater than a remaining portion of the curl.

13. The can end of claim 11 wherein the portion of the curl is adapted to engage the public side of the dome-shaped center panel.

14. The can end of claim 13 wherein the portion of the curl engages the public side of the dome-shaped center panel.

15. The can end of claim 9 wherein the narrow strip of the central webbing has first and second opposing sides each including a curl of the central webbing, a portion of one of the curls of the central webbing approaching the public side of the dome-shaped center panel to ensure the height of the lift end above the public side of the dome-shaped center panel is greater than 0.050 inches.

16. A beverage containing vessel, the beverage containing vessel comprising:

a container body;

an end member for sealing a beverage within the vessel, the end member including a center panel having a product side, a public side, a rivet, a displaceable tear panel in the center panel at least substantially defined by a frangible score and a non frangible hinge segment, and a non-detachable tab staked to the center panel by the rivet;

a central axis extending through the rivet and substantially bisecting the displaceable tear panel;

an internal pressure creating an outward force on the end member wherein the center panel of the end member has a domed profile in response to the outward force; and the non-detachable tab comprising:

a nose end extending over a portion of the tear panel and aligned with the central axis in a position to begin a can end opening sequence;

a lift end opposite the nose end and aligned with the central axis in a position to begin a can end opening sequence; and a central webbing between the nose and lift end, the webbing having a hinge region and a rivet island surrounding the rivet, the rivet island being at least partially surrounded by a first void region to provide a first exposed area of the center panel, a portion of the tab located between the first void region and the lift end extending downwardly below the rivet island and engaging the domed profile of the center panel wherein a height of the lift end of the tab above the public side of the center panel is maintained at a predetermined level and below the curl defining the outer perimeter of the can end.

17. The beverage containing vessel of claim 16 wherein the central webbing further comprises a second void region between the lift end and the first void region to provide a second exposed area of the center panel, the second void region having a perimeter defined by a curl of the central webbing, a portion of the curl extending downwardly and approaching the public side of the center panel wherein a height of the lift end of the tab above the public side of the center panel is maintained at greater than 0.050 inches.

18. The beverage containing vessel of claim 17 wherein the second void region has a perimeter defined by a downwardly projecting curl of the central webbing, a portion of the curl along the narrow strip of the central webbing separating the first void region from the second void region approaching the public side of the center panel to maintain the height of the lift end above the public side of the center panel at greater than 0.050 inches.

19. The beverage containing vessel of claim 18 wherein the portion of the curl has a radius of curvature greater than a remaining portion of the curl.

20. The beverage containing vessel of claim 19 wherein the portion of the curl is adapted to engage the public side of the center panel.

21. The beverage containing vessel of claim 19 wherein the portion of the curl engages the public side of the center panel.

* * * * *